United States Patent [19]

Egbert et al.

[11] Patent Number: 5,066,059

[45] Date of Patent: Nov. 19, 1991

[54] DRILL STRING COMPENSATOR WITH IMPROVED TRANSLOADERS

[75] Inventors: Gary L. Egbert; Philip L. Ziegler III, both of Houston, Tex.

[73] Assignee: Baroid Technology, Inc., Houston, Tex.

[21] Appl. No.: 504,113

[22] Filed: Apr. 3, 1990

[51] Int. Cl.[5] ..... B66C 1/34; B66C 13/04

[52] U.S. Cl. ..... 294/82.16; 267/70

[58] Field of Search ..... 294/1.1, 82.11, 82.15, 294/82.16; 166/355; 175/5, 7, 27, 85; 248/317, 576, 578, 613; 254/270, 277, 337, 900; 267/69, 70, 135-138, 162

[56] References Cited

U.S. PATENT DOCUMENTS

| | | | |
|---|---|---|---|
| 906,712 | 12/1908 | Hines | 267/70 |
| 2,570,320 | 10/1951 | Christensen | 294/82.16 X |
| 3,220,717 | 11/1965 | Altherr et al. | 267/70 |
| 3,242,541 | 3/1966 | Freeman | 267/70 X |
| 3,719,349 | 3/1973 | Dulaney | 267/135 |
| 3,804,183 | 4/1974 | Duncan et al. | 254/277 X |
| 4,433,831 | 2/1984 | Bunger | 267/70 X |
| 4,498,698 | 2/1985 | Zimmermann | 294/82.16 |
| 4,697,798 | 10/1987 | Pitter et al. | 267/70 |
| 4,723,805 | 2/1988 | Bates, Jr. et al. | 294/82.16 |

*Primary Examiner*—Johnny D. Cherry

*Attorney, Agent, or Firm*—Browning, Bushman, Anderson & Brookhart

[57] ABSTRACT

Improved methods and apparatus are provided for adjusting a drill string compensator used for supporting a tubular string passing through a marine drilling vessel. First and second frames of the compensator are interconnected by a plurality of chains or other suitable force transmitting members, eacvh having a threaded rod connected at one end and passing through a respective bore in one of the frames. A plurality of ring-shaped transloader assemblies are provided for uniform tensioning of the force transmitting members, and each transloader assembly is independently axially movable and rotatable about its respective threaded rod. Each transloader assembly preferably includes a sleeve for transmitting load forces between the force transmitting members and the frame, and each sleeve is constructed such that only compressional forces are induced in the sleeve by the load. A biasing device and follower are provided for each of the transloader assemblies such that a uniform biasing force is applied to each of the force transmitting members, while selective positioning of each nut along its respective threaded rod provides for equal working lengths for each flexible force transmitting member. According to the method of the present invention, the force transmitting members are then re-positioned by the insertion of a spacer bar between each transloader and a compensator frame.

32 Claims, 2 Drawing Sheets

DRILL STRING COMPENSATOR WITH IMPROVED TRANSLOADERS

BACKGROUND OF THE INVENTION

1. Field of the Invention

The present invention relates to methods and apparatus for transmitting a load to the plurality of load supporting members, so that each member is supporting its share of the total supported load. More particularly, the present invention relates to a drill string compensator with improved transloaders, and to a method for preloading the compensator to eliminate any slack in the load supporting members.

2. Description of the Background

Those skilled in the offshore oil, gas, or geothermal drilling industry appreciate that drill string compensators are commonly employed to compensate for the vertical motion imparted to a marine drilling vessel by normal wave action. During drilling or when conducting other undersea operations, this compensation is necessary and/or beneficial so that the drill string remains stationary with respect to the seabed, and is thus not responsive to the wave action. Marine vessels suitable for drilling commonly employ a derrick fixed to the deck, with a crown block at the upper end of the derrick and a traveling block suspended from the crown block by an array of cable lines. The cable lines extend between the sheaves of the blocks and then to the drawworks which is controllably rotated to raise or lower the traveling block. A traveling block has a hook to which an elevator or other suitable equipment is connected for grasping the top portion of the drill string, which extends downward through the water and into the seabed. A fluid actuated compensator system provides a reciprocal motion which allows the hook to be maintained at a fixed location relative to the seabed floor as the traveling block heaves with the wave action imparted to the vessel. Such compensators require that the weight of the compensation apparatus be supported by the same cable line which supports the traveling block from the crown block.

A pair of hydraulic or pneumatic piston and cylinder assemblies with multiple chain arrays typically provide the actual interconnection between the main frame and the movable frame of the compensator. The present invention relates to techniques for adjusting those chain arrays to ensure that each of the parallel load supporting members in the drill string compensator supports its intended share of the total supported load. Proper adjustment of the load supporting members in the compensator thus avoids an overload of one of the chains, which may otherwise result in a significantly decreased useable life for the chains, or could result in catastrophic failure of one or more of the chains.

Techniques have heretofore been employed for adjusting the load supporting members of a drill string compensator so that they each support approximately the same load. More refined techniques for accurately adjusting these load support members are disclosed in U.S. Pat. No. 4,723,805. The methods and apparatus of the '805 patent thus represent a significant improvement over techniques previously utilized for attempting to ensure that the weight of the drill string is shared equally by each of the plurality of load supporting members in the drill string compensator.

In spite of the advancements made by providing a transloader for a drill string compensator, the acceptance and use of a compensator with a transloader has heretofore been limited by a number of problems relating to the transloader. Drilling operators continue to have concerns over the additional weight added to the drill string compensator by the transloader. Also, improved techniques are preferred to facilitate the installation and maintenance of the transloader, and to improve the safety and operation of a drill string compensator with a transloader. Moreover, prior art equipment of the type described in the '805 patent does not adequately insure that the drill string compensator cylinders do not "bottom out" before the compensator is in position so that it can be locked out of service.

These disadvantages of the prior art are overcome by the present invention, and improved methods and apparatus are hereinafter disclosed for adjusting the tension in the plurality of chains of a drill string compensator to provide a uniform distribution of the supported load on each of the plurality of supporting members.

SUMMARY OF THE INVENTION

A drill string compensator includes a plurality of flexible force transmitting members, e.g., chains, each interconnecting the main frame and the movable frame of the compensator. A threaded rod or similar member is connected to each of the force transmitting members, and may extend through a bore in the main frame. A separate transloader assembly is provided for each of the plurality of threaded rods, and includes springs or other suitable means for applying a biasing force on each of the force transmitting members. A nut associated with each of the threaded rods forms an adjustment device for controllably increasing or decreasing a gaged dimension between each transloader assembly and a corresponding nut plate, thereby enabling the effective length of the flexible force transmitting members to be easily equalized.

The present invention utilizes a separate transloader assembly for each of the respective force transmitting members. Accordingly, the design of a drill string compensator may be altered to add or remove one or more force transmitting members, depending on the anticipated load to be supported by the compensator, without affecting the overall design of the compensator or the design or manufacture of the transloaders for that compensator. Each transloader assembly is axially moveable along the threaded rod secured to a respective force transmitting member irrespective of the position of the remaining transloader assemblies. For ease of installation, each transloader assemblies is also preferably rotatable about the threaded rod. A sleeve-shaped body provided for each transloader assembly carries in compression the full load transmitted to its respective force transmitting member during use of the compensator, with the compressional force creating no moments which would otherwise cause tensile stresses in the body. Accordingly, the components of the transloader assembly are not as susceptible to failure as prior art transloader components, particularly under relatively low operating temperatures.

According to the method of the present invention, an appropriate "space-out" may be easily applied to the adjustable force transmitting members to substantially decrease or eliminate the possibility of the compensator cylinders bottoming out before the compensator is in position so that it can be locked out. The adjustable nuts may be rotated in a manner similar to that described in the '805 patent so that a desired gage dimension exists between the transloader body and the nut plate. Thereafter, the compensator cylinders may be retracted, and a spacer bar positioned between the compensator block and the end surface of each of the transloader assemblies opposite its respective nut. The compensator cylinders thereafter may be extended, with the spacer bar serving to ensure that the compensator can thereafter be safely locked out of service even though some stretch or wear in the chains has occurred.

It is an object of the present invention to provide an improved drill string compensator having a plurality of force transmitting members and a transloader assembly associated with each of the force transmitting members.

It is a further object of the invention to provide a transloader assembly for a drill string compensator wherein the supporting force acting on each of the transloader assembly components does not subject such components to any significant tensile stresses.

It is another object of the invention to provide improved techniques for easily spacing a plurality of force transmitting members in a drill string compensator, such that each force transmitting member supports its respective share of the total load, yet the compensator can be reliably locked out of service.

It is a feature of this invention to provide a drill string compensator having a plurality of transloaders, such that the overall weight of the compensator may be reduced compared to prior art compensators having a single transloader on each side of the compensator.

It is an additional feature of the invention to provide simple yet safe techniques for easily adjusting the load supported by a plurality of force transmitting members in a drill string compensator to reduce the likelihood of improper adjustment or operator failure to adjust the force transmitting members.

It is a further feature of the present invention to provide simplified techniques for facilitating the safe installation and maintenance of transloaders in a drill string compensator.

It is yet another feature of this invention to provide a spacer bar which is pivotably connected to the main frame of a drill string compensator, such that the spacer bar may be swung out of engagement with the plurality of transloader assemblies, the transloader assemblies adjusted for the proper gage dimensions at each of the respective force transmitting members, and the spacer bar subsequently repositioned between the main frame and each of the plurality of transloaders.

It is an advantage of the present invention that the transloaders on a drill string compensator may be more easily repaired and installed, since each transloader assembly is self-contained and is associated with a respective force transmitting member. Each transloader assembly may thus be easily removed and replaced by another transloader assembly without affecting the remaining transloader assemblies.

These and further objects, features, and advantages of the present invention will become apparent from the following detailed description, wherein reference is made to the figures in the accompanying drawings.

BRIEF DESCRIPTION OF THE DRAWINGS

The present invention will now be described by way of example with reference to the accompanying drawings, in which.

DETAILED DESCRIPTION OF PREFERRED EMBODIMENTS

Figure 1:
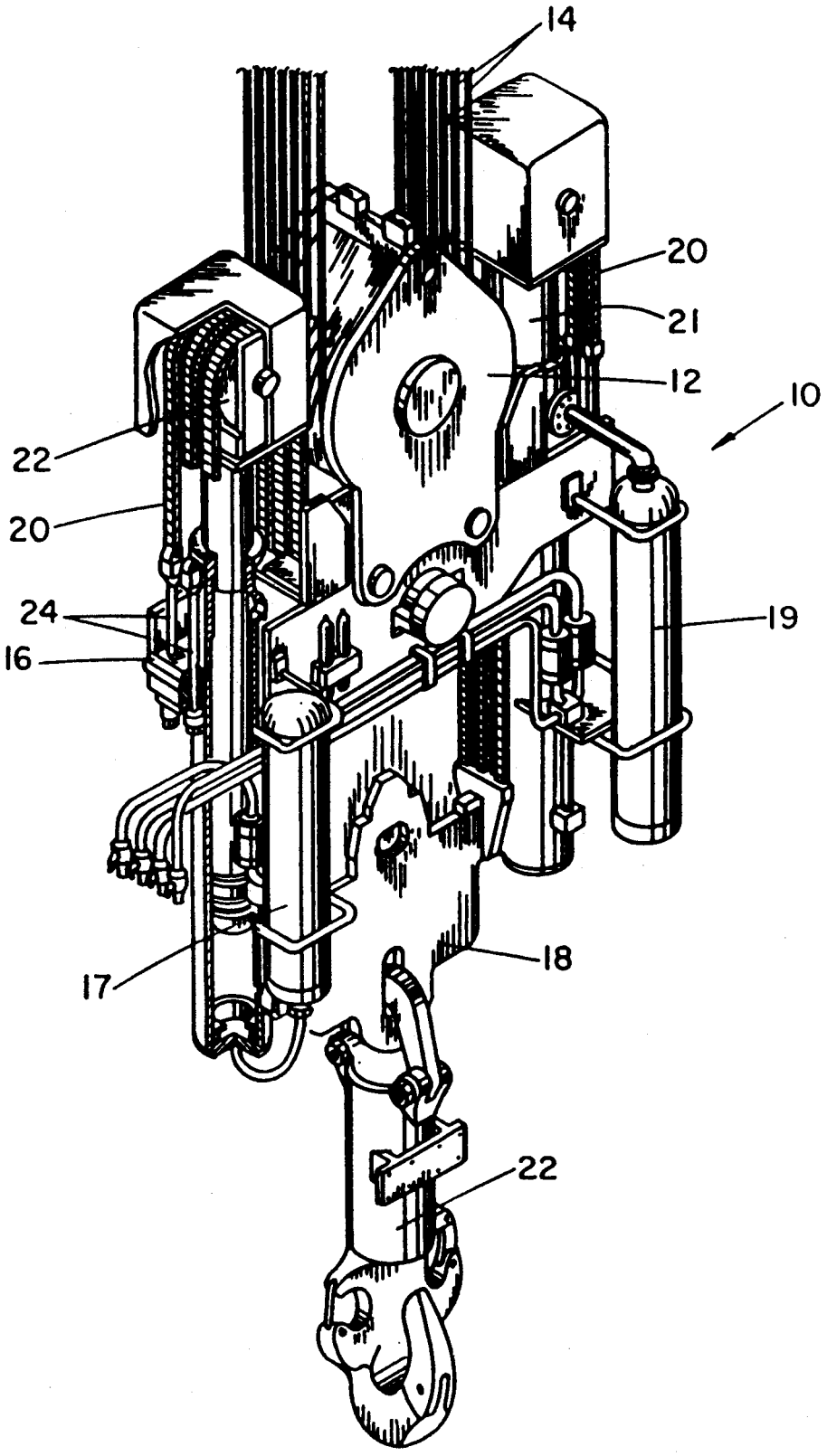
FIG. 1 is a perspective view of a suitable compensator according to the present invention.

FIG. 1 generally depicts a drill string compensator according to the present invention, which may be used in an offshore well drilling system to compensate for the vertical motion imparted to the drilling vessel. The derrick or mast is typically mounted on a submersible or floating platform in a body of water, and a crown block is fixed to the top of the mast and has a plurality of sheaves for receiving a conventional array of lines connected to a drawworks. A traveling block is suspended from the crown block by the array of lines, and the drill string compensator as shown in FIG. 1 is conventionally carried by and positioned immediately below the traveling block, so that the drill string is physically suspended from the drill string compensator The arrangement as described above is well known in the art, and accordingly will not be discussed in detail herein. Details with respect to prior art drill string compensators and the operation of such compensators are disclosed in U.S. Pat. Nos. 3,804,183 and 4,723,805, each of which is hereby incorporated by reference.

The drill string compensator 10 as shown in FIG. 1 is thus suspended from a movable or traveling block 12, which in turn is suspended from a crown block (not shown) by a plurality of cables 14. The compensator includes a main frame (cross-beam block) 16 and a hook plate 18, which are movably interconnected by a plurality of chains 20 on each side of the compensator. Piston rod and cylinder assemblies 21, along with one or more accumulators 17 and air/oil reservoirs 19, control movement between the main frame 16 and the hook plate 18 in conventional fashion. As shown in FIG. 1, three such flexible chains are provided on each side of the compensator for interconnecting the main frame and the hook plate, although any number of flexible chains could be utilized in accordance with the present invention. A conventional hook assembly 22 may be supported from the hook plate 18 of the drill string compensator, so that any suitable device, such as an elevator (not shown) may thereafter be attached to the hook assembly 22 for grasping the drill string.

Figure 2:
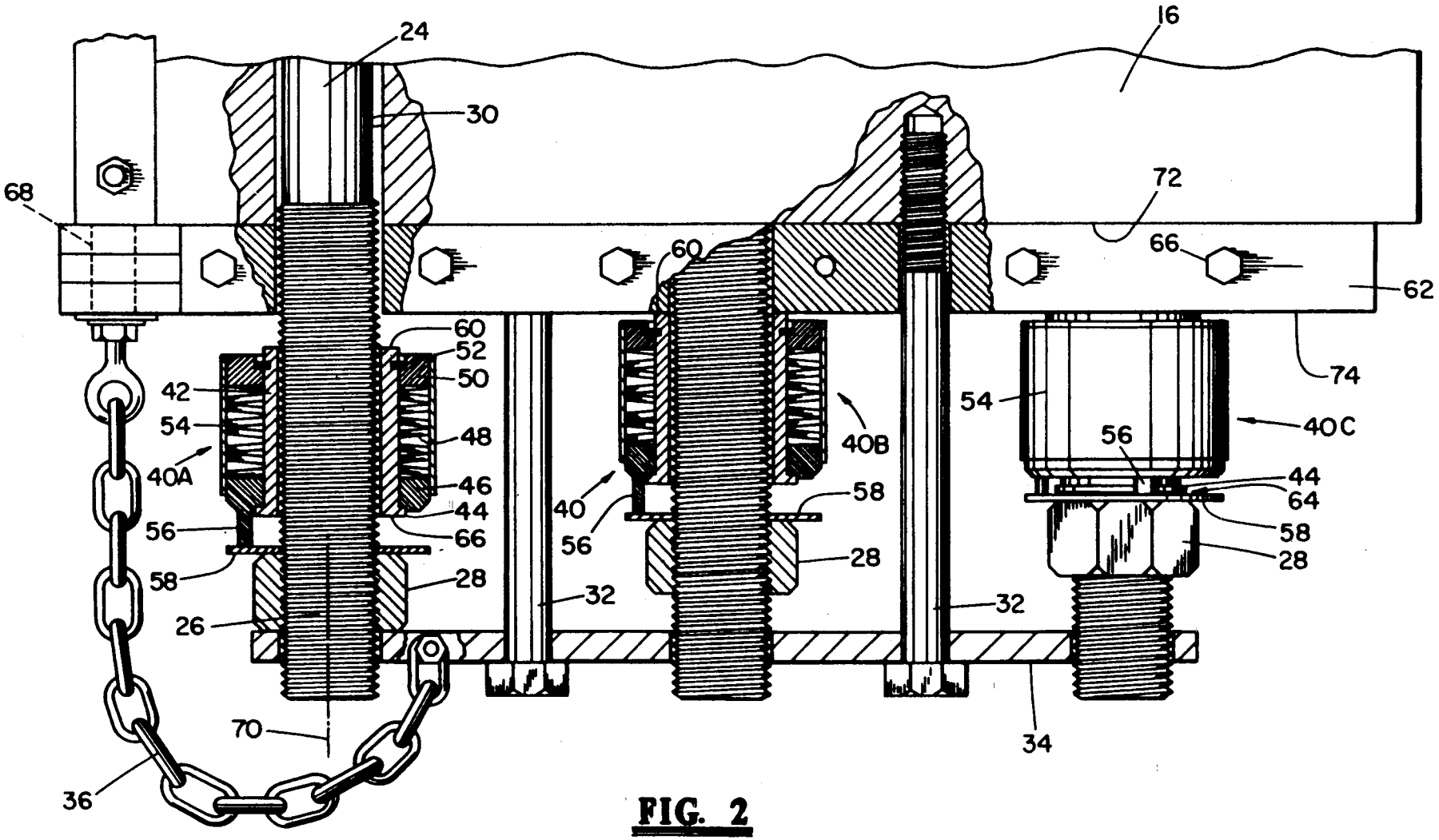
FIG. 2 is a side elevation view, partially in cross-section, of a plurality of transloaders each associated with a respective one of the force transmitting members on one side of the drill string compensator shown in FIG. 1.

Referring to FIGS. 1 and 2, each flexible force transmitting member passes about a chain sheave assembly 22 and is secured to the main frame 16 by a chain adjustment rod 24, which in turn passes through a bore in the main frame. The lower end portion 26 of each of the rods 24 is threaded, as shown in FIG. 2, for receiving an adjustment nut 28. One end of each chain may thus be adjustably secured to the main frame by a threaded rod and nut adjustment mechanism, while the other end of each chain is fixedly secured to the hook plate. Since the length in each of the chains may vary due to stretch and wear, each chain must be properly adjusted to carry its respective share of the total load. Accordingly, the apparatus of the present invention insures uniform tensioning of each of the chains so that the load is uniformly carried by the plurality of force transmitting members, thereby prolonging chain life and reducing the likelihood of a failure. Although FIG. 1 depicts each threaded rod passing through a bore in a main frame, which is the preferred construction, the adjustment rod associated with each chain could pass through a suitable bore in the hook plate 18 to obtain the desired tensioning.

Referring now to FIG. 2, one end of the main frame 16 is shown with three rods 24 each passing through a respective bore 30 in the main frame. Each rod 24 is thus secured to a respective chain 20 (see FIG. 1), and tension in the chain is controlled by moving the nut 28 along the threaded portion 26 of each rod. A pair of bolts 32 are not directly involved in adjustment of the chains 20, but support a nut reinforcing bar 34 which effectively acts as a back-up or jam nut to prevent inadvertent loosening of each of the nuts 28 along its respective rod 24. Also, bar 34 restricts the downward travel of the rods 24 when the cylinders in the compensator 10 are retracted, thereby allowing the chains 20 to become slack. Chain 36 is secured at one end to the main frame 16 and has its other end secured to the bar 34 to prevent bar 34 from inadvertently dropping to the floor of the drilling vessel.

A ring-shaped transloader assembly 40 is thus associated with each of the rods 24 and the chain 20 connected thereto. Each assembly 40 includes a substantially sleeve-shaped body 42 having an inner cylindrical surface with a diameter only slightly greater than the threaded portion 26, so that the body 42 and the remaining components of the assembly 40 are restricted to substantially axial movement along each rod. Also, this design enables independent axial and rotational movement of each assembly 40 with respect to the rod 24, thereby facilitating ease of installation and repair of the transloader assemblies.

The lower end of each body 42 has a radially outward projecting step portion 44, which acts as a stop for lower spring follower 46. A biasing member, such as the plurality of belleville washers 48, are positioned radially about the body 42, and are sandwiched between the lower spring follower 46 and an upper spring follower 50. The follower 50 is preferably secured to body 42 by a retaining ring 52, which snap fits into a groove provided in the body 42. The lower follower 46 has a cylindrical inner surface which allows the lower follower to slide along the outer cylindrical surface of the body 42, so that axial movement of the follower 46 toward the follower 50 further compresses the springs 48. A sleeve-shaped cover 54 is fixed to the follower 50 and extends downward to enclose the springs 48 and at least a portion of the follower 46. Cover 50 gives physical protection to the springs 48, and also houses a lubricant (not shown) which decreases friction between moving parts of the assembly 40 and thereby extends the life of the transloader assembly.

The transloader assembly 40A shown in FIG. 2 is initially positioned on the threaded portion 26 of its respective rod 24, and is held on the rod by nut 28. A plurality of protrusions 56 preferably arranged in an axisymmetrical pattern are each fixed to the lower follower 46, and extend downward to engage a washer-like plate 58 positioned on the rod above the nut 28. While only one of the transloader assemblies shown on FIG. 2 is in the position described above, it should be understood that all transloader assemblies may be initially placed on their respective rods in a manner substantially similar to that described above and shown with respect to assembly 40A, and that each assembly 40 would thereafter be urged upwardly along its respective rod, as explained subsequently.

Each of the transloader assemblies may then be positioned as assembly 40B shown in FIG. 2 by tightening the nut 28 to move axially toward the main frame 16. In the position of assembly 40B, the lower end of each of the protrusions 56 is in engagement with the plate 58, and the upper end surface 60 of the body 42 is in engagement with the spacer bar 62. Any further tightening of the nut 28 will move the spring follower 46 axially toward the upper follower 50, thereby further compressing the springs 48 to place a tensile load on the chains 20 (see FIG. 1). Uniform tensioning of the chains may be obtained by providing uniform gaps or gage dimensions 64 (see assembly 40C) between the lower end surface 66 of the bodies 42 and the upper surface of the plates 58.

It should be understood each transloader assembly may be easily and safely added to each threaded rod provided in a drill string compensator without altering the design or operation of the transloader assembly. This feature not only reduces maintenance costs, but allows a drill string compensator to include, for example, six bores in the main frame of the compensator, although only four chains may be provided and accordingly only four bores may be occupied by a threaded rod. If the total load requirements for the compensator change, however, two additional chains and rods may be added, in which case two additional transloader assemblies will be added to uniformly tension the newly added load supporting members. The versatility of the compensator is increased while the manufacturing cost is substantially reduced compared to a compensator with a single transloader for adjusting all of the plurality of load supporting members.

Referring again to the transloader assembly 40B shown in FIG. 2, it should be understood that when the compensator is in use the transloader body 42 is subject to the full load to be carried by its respective chain and threaded rod. This loading is, however, entirely a compressive force on the body 42 since the load on the threaded rods causes the nuts 28 to be pulled toward the frame 16. According to the present invention, it is significant that no component of the transloader assembly is subject to any substantial tensile forces and/or moments which would induce tensile stresses. Such tensile stresses, which existed in components of prior art transloaders for drill string compensators, rendered those components more susceptible to failure than do compressive stresses. Accordingly, such prior art transloader components had to be manufactured from more expensive materials and had to be tested, particularly under low operating temperatures, to reduce the likelihood of failure. No such additional manufacturing costs or testing costs are necessary for the transloader assembly of the present invention, since the only component subject to this high load is entirely in compression. Accordingly, at least a portion, if not all, of the upper engaging surface 60 of each transloader assembly is positioned the same distance from the centerline 70 of the threaded rod as the lower engaging surface 66 of the body 42, and the sleeve-shaped body 42 has a generally uniform cross-sectional configuration to insure that no portion of this component is subject to or "sees" any substantial tensile stress when the compensator is in operation.

It is a feature of the present invention to provide a mechanism for effectively shortening each of the flexible load supporting members an equal amount. A spacer bar 62, preferably having two halves, is provided as shown in FIG. 2. Each half of the spacer bar is preferably pivotably connected by pin 68 to the main frame 16 at one end thereof, so that both halves can be easily swung outwardly from the main frame and subsequently returned to the position shown in FIG. 2. In practice, the bolts 66 securing each of the spacer bars in the position shown in FIG. 2 may be disengaged, and the bars rotated out of the way of the transloaders. End surface 60 of each of the transloader assemblies may thus engage surface 72 of the main frame rather than surface 74 of the spacer bars. The drill string cylinders 21 (see FIG. 1) may then be fully extended thereby bringing one or more of the transloader assemblies into engagement with surface 72 of frame 16. The nuts 28 may then be adjusted to provide a uniform working length for each of chains in the manner described in U.S. Pat. No. 4,723,805, at which time all of the transloader assemblies will engage frame 16. Once uniform adjustment is achieved, the compensator cylinders 21 may be retracted to allow the rods 24 to drop downwardly, so that the transloader assemblies drop several inches below the main frame. The spacer bars may then be returned to a position between the transloader assemblies and the main frame, and the bolts 66 tightened to secure the spacer bars in this position.

The piston and cylinder assemblies are then again extended so that the transloader assemblies 40 are each sandwiched between the spacer bar 62 and the washer 58 above each respective nut 28. The compensator is then ready for use, with each chain thereafter carrying its share of the total load (generally the weight of the drill string on the compensator), and this partial load is transmitted from the nut on each threaded rod to the frame 16 by placing the sleeve 42 entirely in compression.

Those skilled in the compensator art recognize that it is occasionally desirable to lock the main frame to the hook plate. In the compensator as disclosed in U.S. Pat. No. 4,723,805, the lockout mechanism could not be activated if the chains lengthened, since the cylinders could bottom out before the hook plate was properly positioned for lockout. According to the present invention, the chains may wear and lengthen, yet the "space-out" provided by the spacer bar allows for the continuous yet reliable operation of the compensator without the need to repeatedly readjust the nuts 28. This feature effectively insures that the compensator cylinders will not bottom out before the compensator is in position so that it can be locked out, even though the effective length of the chains increases over time due to stretch and/or wear.

Various modifications to the transloader assemblies in a drill string compensator are anticipated by and within the scope of this invention. For example, various types of biasing means other than belleville springs may be used for each of the compensator assemblies. A single coiled spring could be used rather than a stack of belleville springs. Also, some type of energy storing device other than springs, such as a gas or hydraulic energy storing device, could be used to subject each of the chains to the desired preload. Although the combination of a threaded rod attached to each chain 20 and an adjustment nut allows for easy and controlled adjustment of the chains, other conventional adjustment devices could be used for regulating the length of the chains so that all chains are of a uniform length. Depending on the type of compensator, a hook frame may be substituted for the hook plate 18, and serves the same purpose. The main frame and cross-beam block may be separate components conventionally secured together by bolts, although they are discussed herein on a unitary structure.

These and other modifications and changes should now be apparent to those skilled in the art from the foregoing description of the invention, and may be made without departing from the spirit or essential characteristics of this invention. Accordingly, the scope of the invention should be determined by the following pended claims.

What is claimed is:

1. A drill string compensator for supporting a tubular string having an axis and passing through a marine vessel subject to wave action, the drill string compensator comprising:

a first frame supported above the marine vessel and controllably moveable along the axis of the tubular string;

a second frame supported by the first frame and movable with respect to the first frame along the axis of the drill string;

one of the first and second frames having a plurality of bores therethrough;

a plurality of flexible force transmitting members for interconnecting the first and second frames;

a plurality of threaded rods each connected to an end of a respective one of the plurality of flexible force transmitting members and passing through a respective one of the plurality of bores:

a plurality of nuts each associated with a respective one of the threaded rods: and a plurality of ring-shaped transloader assemblies for uniform tensioning of the flexible force transmitting members, each of the transloader assemblies being positioned about and axially movable with respect to its respective threaded rod, each transloader assembly including:

(a) a sleeve positioned between a respective nut and the frame having the plurality of bores for transmitting load forces from the respective nut to the frame having the plurality of bores, (b) a biasing device for exerting a biasing force on the respective nut and the corresponding force transmitting member, and (c) a follower movable with respect to the sleeve for compressing the biasing device in response to rotation of the respective nut with respect to the respective threaded rod, such that the selective positioning of each of the nuts along its respective threaded rod ensures an equal working length for each of the respective flexible force transmitting members.

2. The drill string compensator as defined in claim 1, wherein each of the transloader assemblies further comprises:

the sleeve having a substantially uniform cross-sectional configuration and a central axis; and the sleeve having an upper load force engaging surface and a lower load force engaging surface each spaced substantially equidistance from the central axis and radially between the central axis and a perimeter of a corresponding nut, such that the transmitted load force induced only compressional forces in the sleeve.

3. The drill string compensator as defined in claim 1, wherein each of the transloader assemblies further comprises:

a sleeve-shaped cover positioned radially outward of the biasing device for housing the sleeve, the biasing device, and at least a portion of the follower.

4. The drill string compensator as defined in claim 1, wherein the biasing device is radially outward of the sleeve, the sleeve has an outer cylindrical surface, and the follower is slideably movable along the outer cylindrical surface of the sleeve for compressing the biasing device.

5. The drill string compensator as defined in claim 1, wherein each of the transloader assemblies further comprises:

a retainer secured to the sleeve for limiting movement of the biasing device in response to movement of the follower with respect to the sleeve.

6. The drill string compensator as defined in claim 1, wherein each sleeve has a cylindrical internal surface such that each transloader assembly is rotatable about its respective threaded rod.

7. A drill string compensator as defined in claim 1, wherein each sleeve includes a radially outward projecting member for limiting axial movement of each follower toward its respective nut.

8. A drill string compensator as defined in claim 1, further comprising:

a protrusion secured to the follower and extending toward the respective nut for moving the follower to compress the biasing device in response to rotation of the nut.

9. The drill string compensator as defined in claim 1, wherein the biasing device is a spring member.

10. The drill string compensator as defined in claim 9, wherein the spring member comprises a stack of belleville springs.

11. A drill string compensator for supporting a tubular string having an axis and passing through a marine vessel subject to wave action, the drill string compensator comprising:

a first frame supported above the marine vessel and controllably moveable along the axis of the tubular string, the first frame having a plurality of bores therethrough;

a second frame supported by the first frame and movable with respect to the first frame along the axis of the drill string;

a plurality of flexible force transmitting members for interconnecting the first and second frames;

a plurality of rods each connected to an end of a respective one of the plurality of flexible force transmitting members and passing through a respective one of the plurality of bores in the first frame;

a plurality of adjustment members each movable with respect to a respective one of the rods; and a plurality of ring-shaped transloader assemblies for uniform tensioning of the flexible force transmitting members, each of the transloader assemblies being positioned about and axially movable with respect to its respective rod, each transloader assembly including:

(a) a sleeve positioned between a respective adjustment member and the first frame for transmitting load forces from the respective adjustment member to the first frame, (b) a biasing device for exerting a biasing force on the respective adjustment member, (c) a follower movable with respect to the sleeve for compressing the biasing device in response to movement of the adjustment member with respect to the rod, such that the selective positioning of each of the adjustment members with respect to its respective rod ensures an equal working length for each of the respective flexible force transmitting members, and (d) a retainer secured to the sleeve for limiting movement of the biasing device in response to movement of the follower with respect to the sleeve.

12. The drill string compensator as defined in claim 11, wherein each of the transloader assemblies further comprises:

the sleeve having a substantially uniform cross-sectional configuration and a central axis; and the sleeve having an upper load force engaging and lower load force engaging surface each spaced substantially equidistant from the central axis and radially between the central axis and a perimeter portion of a corresponding adjustment member, such that the transmitted load force induces substantially only compressional forces in the sleeve.

13. The drill string compensator as defined in claim 11, wherein each of the transloader assemblies further comprises:

a sleeve-shaped cover positioned radially outward of the biasing device for housing the sleeve, the biasing device at least a portion of the follower.

14. The drill string compensator as defined in claim 11, wherein the biasing device is radially outward of the sleeve, the sleeve has an outer cylindrical surface, and the follower is slideably movable along the outer cylindrical surface of the sleeve for compressing the biasing device.

15. The drill string compensator as defined in claim 11, wherein each sleeve has a cylindrical internal surface such that each transloader assembly is rotatable about its respective threaded rod.

16. An improved method of adjusting a drill string compensator for supporting a tubular string, the compensator including a first frame having a plurality of bores therethrough and controllably movable along an axis of the tubular string, a second frame moveable with respect to the first frame along the axis of the drill string, a piston and cylinder assembly for controllably moving the second frame with respect to the first frame, a plurality of flexible force transmitting members for interconnecting the first and the second frame, the plurality of flexible force transmitting members including a plurality of rods each connected to an end of a respective one of the plurality of flexible force transmitting members and passing through a respective one of the plurality of bores and a plurality of adjustment members each associated with a respective one of the rods, the method comprising;

providing a plurality transloader assemblies each having a biasing device therein;

positioning each of the transloader assemblies about the plurality of rods;

actuating the piston and cylinder assembly to move the first frame axially toward the second frame;

adjusting each of the adjustment members such that each of the force transmitting members has an equal working length and each transloader assembly exerts a substantially uniform load on its respective flexible force transmitting member;

actuating the piston and cylinder assembly to remove the substantially uniform load from the flexible force transmitting members;

thereafter inserting a spacer member having a uniform thickness between each of the plurality of transloader assemblies and the first frame; and thereafter actuating the piston and cylinder assembly to move the second frame axially away from the first frame and compressing the biasing device in each of the plurality of transloader assemblies, such that the load on each of the flexible force transmitting members is transmitted to the first frame through its respective transloader assembly and the spacer member.

17. An improved method of adjusting a drill string compensator as defined in claim 16, further comprising:

pivotably connecting the spacer member to the first frame for facilitating removal and insertion of the spacer member between the plurality of transloader assemblies and the first frame.

18. An improved method of adjusting a drill string compensator as defined in claim 16, wherein the step of inserting a spacer member further comprising:

temporarily securing the spacer member in position between the plurality of transloader assemblies and the first frame.

19. An improved method of adjusting a drill string compensator as defined in claim 16, further comprising:

forming a substantially cylindrical internal surface on each transloader assembly such that each transloader assembly is rotatable about it respect rod when positioning the transloader assembly about its respective rod.

20. An improved method of adjusting a drill string compensator as defined in claim 16, wherein the step of positioning each of the transloader assemblies comprises positioning each of the transloader assemblies on and radially about a respective one of the plurality of rods.

21. A ring-shaped transloader assembly for uniform tensioning of one of a plurality of flexible force transmitting members in a drill string compensator used to support a tubular string, the drill string compensator including a first frame, a second frame movable with respect to the first frame along a drill string axis, a plurality of flexible force transmitting members for interconnecting the first and second frames including a plurality of rods each connected to an end of a respective one of the plurality of flexible force transmitting members and a plurality of adjustment members each associated with a respective one of the rods, the transloader assembly being positionable on or about and being axially movable with respect to its respective rod, the transloader assembly further comprising:

(a) a sleeve having an upper end and a lower end, and positionable between a respective adjustment member and one of the first and second frames for transmitting load forces from the adjustment member to the one of the frames, (b) a biasing device radially outward of the sleeve for exerting a biasing force on the respective adjustment member and the corresponding force transmitting member, (c) a follower movable with respect to the sleeve for compressing the biasing device in response to axial adjustment of the adjustment member with respect to the rod, such that the selective positioning of the adjustment member along its respective rod ensures an equal working length for each of the flexible force transmitting members, (d) a radially outward projecting member on the sleeve for limiting axial movement on the follower from the upper end of the sleeve; and (e) a retainer secured to the sleeve for limiting axial movement of the biasing device from the lower end of the sleeve.

22. The transloader assembly as defined in claim 21, further comprising:

the sleeve having a substantially uniform cross-sectional configuration and a central axis; and the sleeve having an upper load force engaging the surface and a lower load force engaging surface each spaced substantially equidistance from the central axis, such that the transmitted load force includes only compressional forces in the sleeve.

23. The transloader assembly as defined in claim 21, further comprising:

a sleeve-shaped cover positioned radially outward of the biasing device for housing the sleeve, the biasing device, and at least a portion of the follower.

24. The transloader assembly as defined in claim 21, further comprising:

the sleeve has an outer cylindrical surface, and the follower is slidably movable along the outer cylindrical surface of the sleeve for compressing the biasing device.

25. The transloader assembly as defined in claim 21, further comprising:

the sleeve having a cylindrical internal surface such that the transloader assembly is rotatable about its respective rod.

26. A drill string compensator for supporting a tubular string having an axis and passing through a marine vessel subject to wave action, the drill string compensator comprising:

a first frame supported above the marine vessel and controllably movable along the axis of the tubular spring;

a second frame supported by the first frame and movable with respect to the first frame along the axis of the drill spring;

one of the first and second frames having a plurality of bores therethrough;

a plurality of flexible force transmitting members for interconnecting the first and second frames each including a rod connected to an end of a respective one of the plurality of flexible force transmitting members and passing through a respective one of the plurality of bores and an adjustment member associated with the rod; and a plurality of transloader assemblies for uniform tensioning of the flexible force transmitting members, each of the transloader assemblies being positioned about a corresponding rod;

a piston and cylinder assembly of controllably moving the second frame with respect to the first frame; and a spacer member having a uniform thickness for selectively removing from and inserting between each of the plurality of transloader assemblies and the one of the first and second frames having the plurality of bores therethrough, such that the load on each of the force transmitting members is transmitted to the one of the first and second frames through the respective transloader assembly and the spacer member when the spacer member is inserted between the transloader assemblies and the one of the frames.

27. A drill string compensator as defined in claim 26, wherein each of the transloader assemblies comprises:

a sleeve positioned between a respective adjustment member and the one of the first and second frames for transmitting load forces from the respective adjustment member to the one of the frames;

a biasing device for exerting a biasing force on the respective adjustment member;

a follower movable with respect to the sleeve for compressing the biasing device in response to movement of the adjustment member with respect to the rod, such that the selective positioning of each of the adjustment members with respect to its respective rod ensures an equal working length for each of the respective flexible force transmitting members; and a retainer secured to the sleeve for limiting movement of the biasing device in response to movement of the follower with respect to the sleeve.

28. A drill string compensator as defined in claim 26, wherein each of the transloader assemblies comprises:

a sleeve positioned between a respective adjustment member and the one of the first and second frames for transmitting load forces from the respective adjustment member to the one of the frames;

a biasing device for exerting a biasing force on the respective adjustment member;

a follower movable with respect to the sleeve for compressing the biasing device in response to movement of the adjustment member with respect to the rod, such that the selective positioning of each of the adjustment members with respect to its respective rod ensures an equal working length for each of the respective flexible force transmitting members; and the sleeve including a radially outward projecting member for limiting axial movement of the follower toward its respective adjustment member.

29. A drill string compensator as defined in claim 26, wherein each of the transloader assemblies comprises:

a sleeve having an upper end and a lower end, and positionable between a respective adjustment member and the one of the first and second frames for transmitting load forces from the respective adjustment member to the one of the frames;

a biasing device radially outward of the sleeve for exerting a biasing force on the respective adjustment member and the corresponding force transmitting member;

a follower movable with respect to the sleeve for compressing the biasing device in response to movement of the adjustment member with respect to the rod, such that the selective positioning of the adjustment member along its respective rod ensures an equal working length for each of the flexible force transmitting members;

a radially outward projecting member on the sleeve for limiting axial movement of the follower from the upper end of the sleeve; and a retainer secured to the sleeve for limiting axial movement of the biasing device from the lower end of the sleeve.

30. The drill string compensator as defined in claim 29, wherein each of the transloader assemblies further comprises:

the sleeve having a substantially uniform cross-sectional configuration and a central axis; and the sleeve having an upper load force engaging surface and a lower force engaging surface each spaced substantially equidistance from the central axis and radially between the central axis and a perimeter of a corresponding adjustment member, such that the transmitted load force induces only compressional forces to the sleeve.

31. The drill string compensator as defined in claim 29, wherein each of the transloader assemblies further comprises:

a sleeve-shaped cover positioned radially outward of the biasing device for housing the sleeve, the biasing device, and at least a portion of the follower.

32. The drill string compensator as defined in claim 29, wherein each sleeve has a cylindrical internal surface such that each transloader assembly is rotatable about its respective rod.

* * * * *

UNITED STATES PATENT AND TRADEMARK OFFICE

CERTIFICATE OF CORRECTION

PATENT NO. : 5,066,059

DATED : November 19, 1991

INVENTOR(S) : Gary L. Egbert and Philip L. Ziegler III

It is certified that error appears in the above-identified patent and that said Letters Patent is hereby corrected as shown below:

In Column 10, line 16 (Claim 12, line 6), insert "surface" after the word "engaging".

In Column 10, line 17 (Claim 12, line 7), insert "a" before the word "lower".

In Column 10, line 29 (Claim 13, line 6), insert a ", and" after the word "device".

In Column 12, line 57 (Claim 26, line 24), change "of" to -- for --.

Signed and Sealed this

Twenty-third Day of March, 1993

*Attest:*

STEPHEN G. KUNIN

*Attesting Officer*

*Acting Commissioner of Patents and Trademarks*